US006282748B1

(12) United States Patent
Thur et al.

(10) Patent No.: US 6,282,748 B1
(45) Date of Patent: Sep. 4, 2001

(54) BRUSHROLL CHAMBER FOR VACUUM CLEANER

(75) Inventors: Charles J. Thur, Chardon; Michael F. Wright, Stow; Mark E. Cipolla, Chardon; Robert N. McKee, Aurora, all of OH (US)

(73) Assignee: Royal Appliance Mfg. Co., Glenwillow, OH (US)

( * ) Notice: Subject to any disclaimer, the term of this patent is extended or adjusted under 35 U.S.C. 154(b) by 0 days.

(21) Appl. No.: 09/482,592

(22) Filed: Jan. 13, 2000

(51) Int. Cl.[7] ..... A47L 9/04
(52) U.S. Cl. ..... 15/383; 15/392
(58) Field of Search ..... 15/363, 383, 391, 15/392, 412

(56) References Cited

U.S. PATENT DOCUMENTS

Re. 31,095 12/1982 Tschudy .
5,513,418 5/1996 Weber .
6,006,402 * 12/1999 Maurer ..... 15/383
6,158,084 * 12/2000 Weber et al. ..... 15/390

* cited by examiner

*Primary Examiner*—Terrence R. Till
(74) *Attorney, Agent, or Firm*—Fay, Sharpe, Fagan, Minnich & McKee, LLP

(57) ABSTRACT

A nozzle base for a vacuum cleaner includes an upright front wall, an upright rear wall spaced from the front wall and having a suction air aperture, first and second upright side walls extending transversely between mutual end edges of the front and rear walls, respectively, and an upper wall joined to the front wall, rear wall, first side wall, and second side wall to define a downwardly opening chamber adapted to rotatably support an associated agitator therein. The upper wall has an intermediate section above the suction air aperture, a first wall section tapering downward from the intermediate section in a direction toward the first upright sidewall, and a second wall section tapering downward from the intermediate section in a direction toward the second upright sidewall. The second wall section terminates at a height below an uppermost extent of the agitator, and the second wall section including a recess adapted to conform generally to the agitator.

15 Claims, 7 Drawing Sheets

BRUSHROLL CHAMBER FOR VACUUM CLEANER

BACKGROUND OF THE INVENTION

The present invention relates to the vacuum cleaner arts, and more particularly to a chamber that houses a powered agitator roll or brushroll for a vacuum cleaner, and will be described with particular reference thereto.

It is known to use a powered (e.g. belt driven) agitator roll or brushroll in a vacuum cleaner nozzle base. Most agitator rolls or brushrolls are formed from a cylindrical dowel having one or more rows of bristles that, in conjunction with a beater bar structure associated with the vacuum cleaner nozzle base, aid in the pickup of dirt from the surface being cleaned. Such powered brushrolls are mounted for rotation in brushroll chambers associated with different types of vacuum cleaners such as upright vacuum cleaners, hand-held vacuum cleaners, canister-type vacuum cleaners having powered floor nozzles, etc.

With reference to FIGS. 1 and 2, a conventional floor nozzle A of an upright-type vacuum cleaner includes a nozzle base section 10. A cylindrical wall 12 extends laterally along the front of the nozzle base section 10 and defines a downwardly opening brushroll chamber or cavity 14 having a constant, arcuate, cross-section along the width W of the nozzle base section. The brushroll chamber 14 is adapted to receive and rotatably support an agitator or brushroll (not shown) in a known manner. A lower cover plate (not shown) cooperates with the brushroll chamber to define a floor nozzle inlet 15.

A slot 16 and a rearwardly extending duct 18 each communicate with and extend rearwardly from opposing ends of the brushroll chamber 14. A power transmission device, such as a continuous drive belt (not shown), is positioned within the slot 16 and transfers rotational power from an output shaft of a drive motor (not shown) to the brushroll (not shown) in a conventional manner. The duct 18 provides a pathway for suction air that is drawn by a source of suction power (e.g. a fan/motor assembly) through the brushroll chamber 14 from the nozzle inlet 15.

A disadvantage associated with the brushroll chamber 14 is that suction air is not drawn evenly into the brushroll chamber along the width of the nozzle inlet 15. That is, the velocity of suction air drawn from the nozzle inlet at locations remote from the suction duct 18 (such as near the slot 16) can be less than the velocity of suction air drawn from the locations that are proximate the suction duct 18, thus reducing the performance of the vacuum cleaner floor nozzle along the edges thereof.

U.S. Pat. No. 5,513,418 discloses a brushroll chamber having an inner, cylindrical brushroll cavity and two laterally extending suction ducts positioned, respectively, forward and rearward of the inner brushroll cavity, which suction ducts taper downward in directions laterally away from a discharge duct. It is desirable to provide upright vacuum cleaners with a profile that is compact, streamlined, and easy to maneuver. However, a vacuum cleaner nozzle base that incorporates such a brushroll chamber with an inner brushroll cavity and forward and rearward suction ducts that are separate from the brushroll cavity, tends to be bulky and less maneuverable due the size and weight of the brushroll chamber. It also requires a complex nozzle body with many walls, thereby adding to the cost of manufacture of the product.

Accordingly, it has been deemed desirable to develop a new and improved brushroll chamber for vacuum cleaner devices that overcomes the foregoing difficulties and others while providing better and more advantageous overall results.

SUMMARY OF THE INVENTION

The present invention is directed to a new and improved brushroll chamber for a vacuum cleaner that provides overall improved suction performance by increasing the velocity of a suction airflow that occurs at points along a nozzle inlet that are located progressively farther from a rearwardly extending suction duct.

In accordance with the first aspect of this invention, a nozzle base for a vacuum cleaner includes a downwardly opening chamber extending across a width of the nozzle base. The chamber is adapted to rotatably support an associated agitator. The chamber includes an upper wall that tapers downward in a widthwise direction relative to the nozzle base. The upper wall extends to a height below an uppermost extent of the agitator. The upper wall includes a recess adapted to conform generally to the agitator.

In accordance with another aspect of this invention, a nozzle base for a vacuum cleaner includes an upright front wall, an upright rear wall spaced from the front wall and having a suction air aperture, first and second upright side walls extending transversely between mutual end edges of the front and rear walls, respectively, and an upper wall joined to the front wall, rear wall, first side wall, and second side wall to define a downwardly opening chamber adapted to rotatably support an associated agitator therein. The upper wall has an intermediate section above the suction air aperture, a first wall section tapering downward from the intermediate section in a direction toward the first upright sidewall, and a second wall section tapering downward from the intermediate section in a direction toward the second upright sidewall. The second wall section terminates at a height below an uppermost extent of the agitator, and the second wall section including a recess adapted to conform generally to the agitator.

In accordance with yet another aspect of the invention, a nozzle base for a vacuum cleaner includes a downwardly opening chamber extending across a width of the nozzle base. The chamber includes an upper wall and a first side wall. The upper wall includes a first upper wall section that tapers from a discharge aperture toward the first side wall. The first upper wall section includes a recessed portion adapted to accommodate a rotation of an associated agitator.

One advantage of the present invention is the provision of a new and improved brushroll chamber for a vacuum cleaner that is compact, lightweight, and easily maneuverable.

Another advantage of the invention is found in the provision of a brushroll chamber having improved suction performance along the full width of an associated nozzle inlet.

Still another advantage of the present invention resides in the provision of a unitary brushroll chamber having a cross-section that varies in a lateral direction away from a rear discharge duct to increase the velocity of air flow at points remote from the discharge duct.

Yet another advantage of the present invention is the provision of a brushroll chamber that incorporates a tapered upper wall portion with a recess for accommodating a rotating brushroll.

Still a further advantage of the present invention is the provision of a brushroll chamber that incorporates a tapered rear wall portion for controlling the velocity of air flow at points remote from a discharge duct.

Still other benefits and advantages of the invention will become apparent to those of average skill in the art upon a reading and understanding of the following detailed description.

BRIEF DESCRIPTION OF THE DRAWINGS

The invention may take form in certain components and structures, a preferred embodiment of which will be illustrated in the accompanying drawings wherein.

DETAILED DESCRIPTION OF THE PREFERRED EMBODIMENTS

Figure 1:
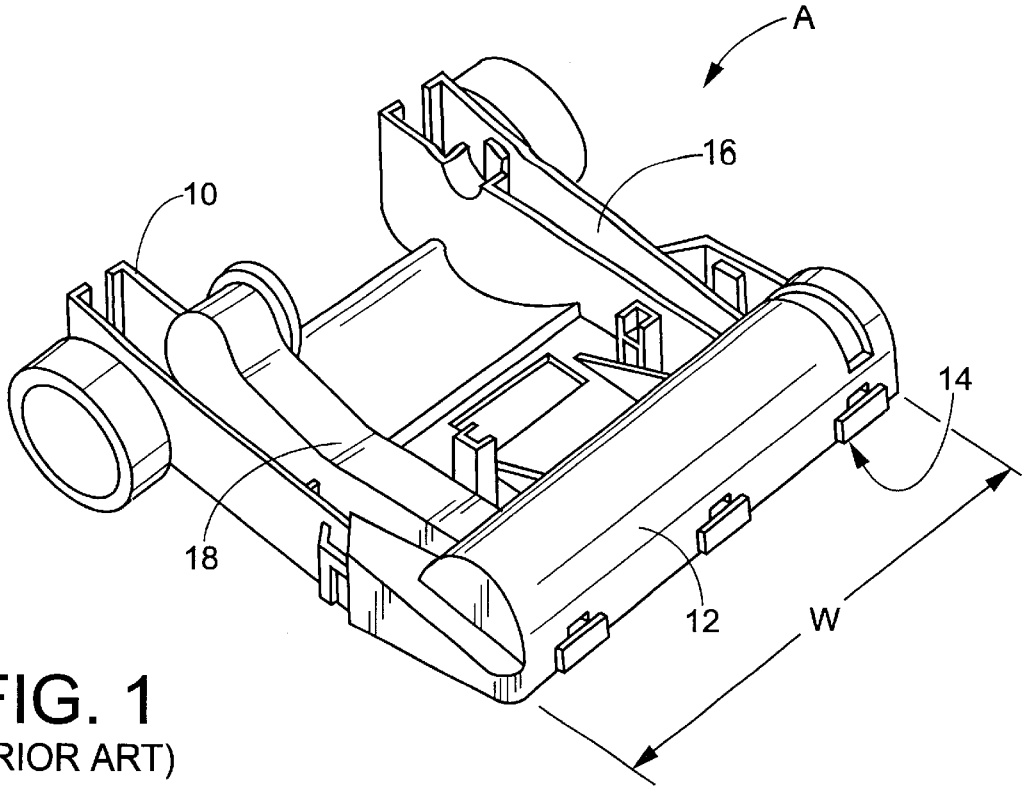
FIG. 1 (PRIOR ART)
FIG. 1 is a perspective view of a conventional nozzle base (with an upper cover or shroud removed) for an exemplary upright-type vacuum cleaner.

Referring now to the Figures, wherein the showings are for purposes of illustrating preferred embodiments of the invention only and not for limiting the same, FIGS. 3–6 illustrate a floor nozzle B of an upright-type vacuum cleaner in accordance with a first embodiment of the present invention. The floor nozzle B is preferably made from a conventional material(s) such as molded plastics and the like. The floor nozzle B includes a nozzle base section 20 having downwardly opening brushroll chamber or cavity 22 that extends laterally along a front portion of the nozzle base section. The brushroll chamber 22 is defined by upright front and rear walls 24 and 26, side walls 28 and 30, and a contoured upper wall 32 that is formed integral with the front, rear, and side walls 24–30.

Figure 3:
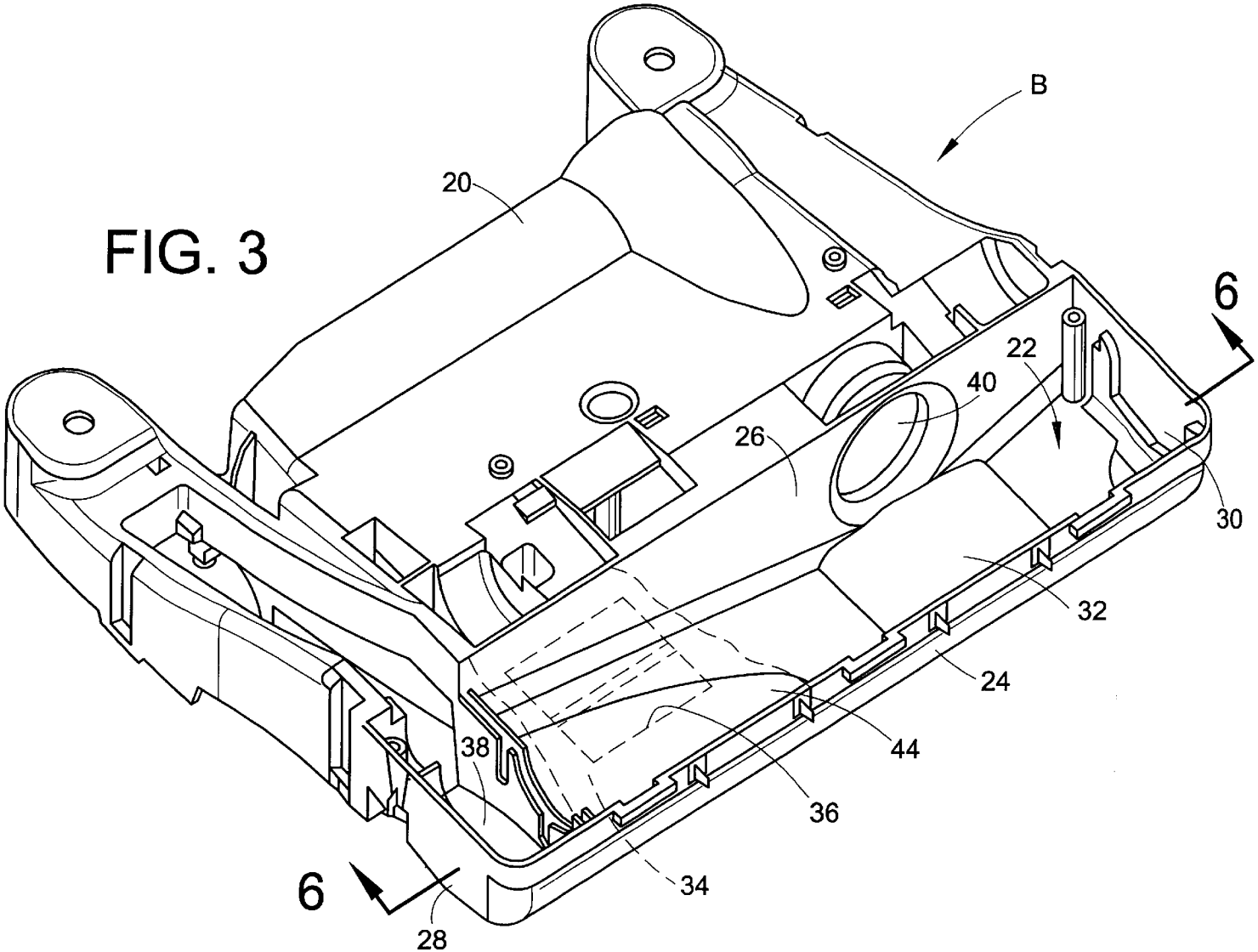
FIG. 3 is a rearward perspective view from the left of a nozzle base (with a lower cover plate removed), positioned upside down, to view a brushroll chamber thereof that incorporates the features of the present invention therein.
Figure 4:
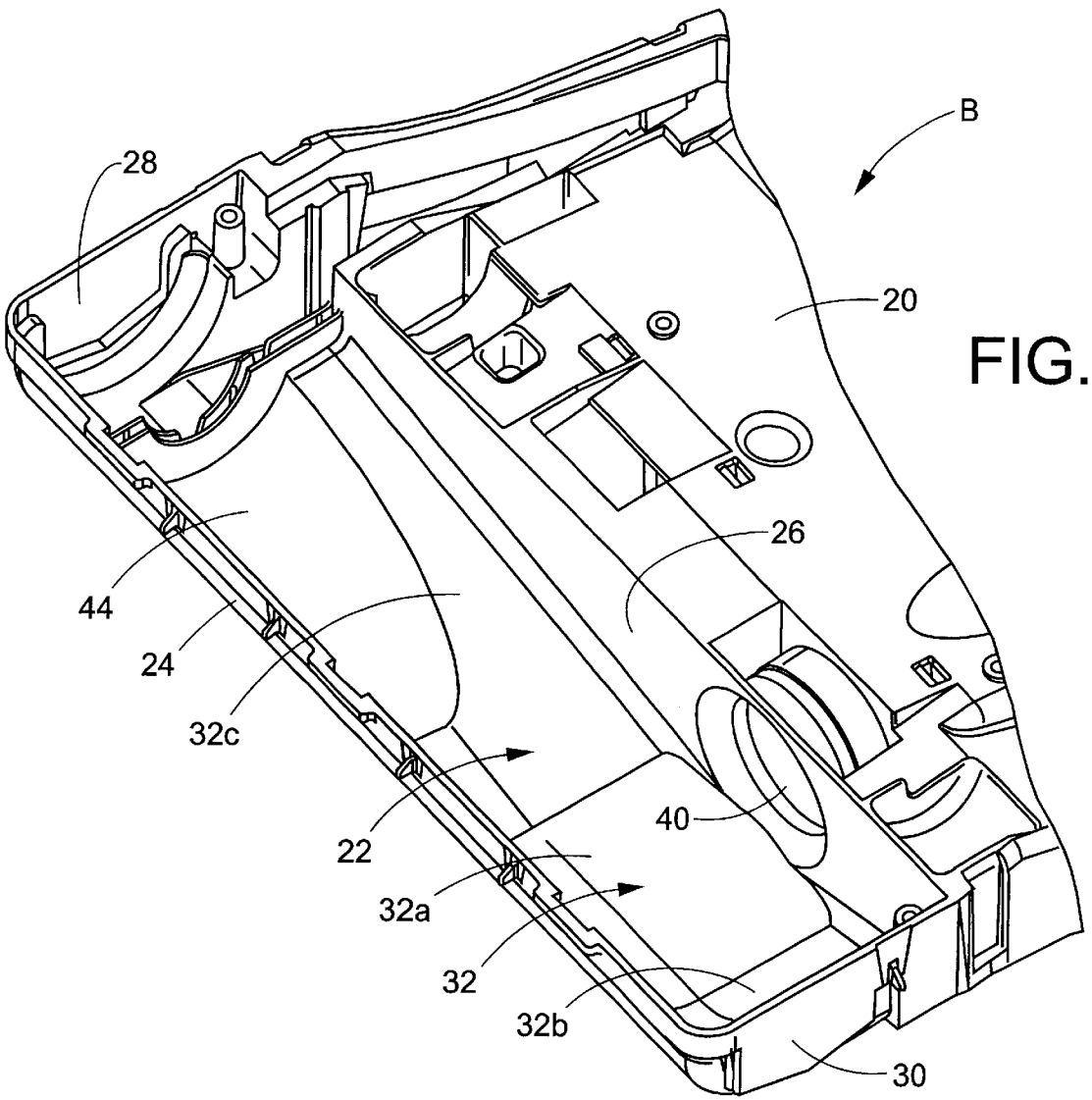
FIG. 4 is a rearward perspective view from the right of the nozzle base of FIG. 3 (with a lower cover plate removed), positioned upside down, to view the brushroll chamber thereof.
Figure 6:
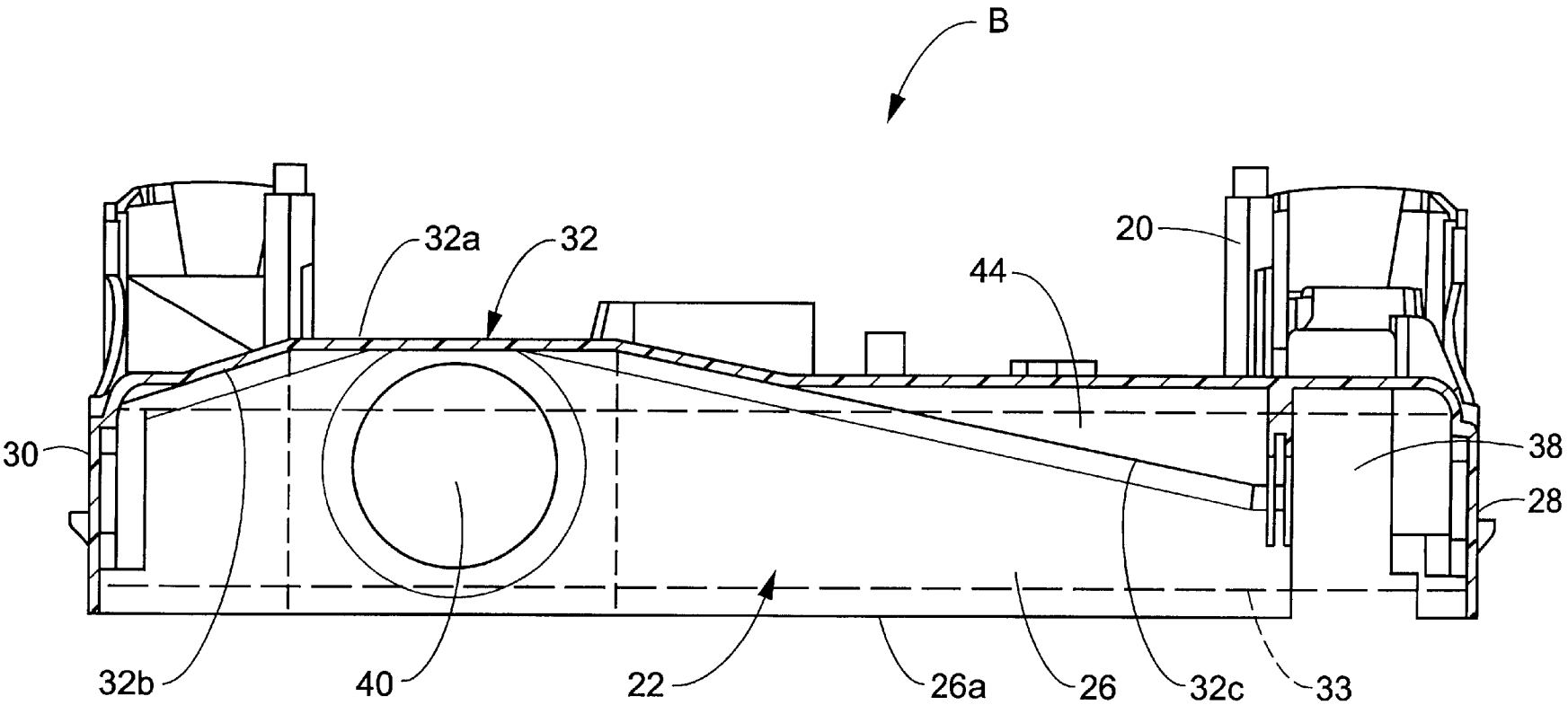
FIG. 6 is a front elevation view in cross section of the nozzle base taken along the line 6—6 in FIG. 3.

As illustrated in FIG. 6, the brushroll chamber 22 is adapted to receive and rotatably support an agitator or brushroll 33 (shown in phantom). Referring now to FIG. 3, a lower cover plate 34 (shown in phantom) cooperates with the brushroll chamber 22 to define a floor nozzle inlet 36. A slot 38 communicates with and extends rearwardly proximate the first side wall 28 of the brushroll chamber 22. A power transmission device, such as a continuous drive belt (not shown), is positioned within the slot 38 and transfers rotational power from an output shaft of a drive motor (not shown) to the brushroll in a conventional manner.

Figure 5:
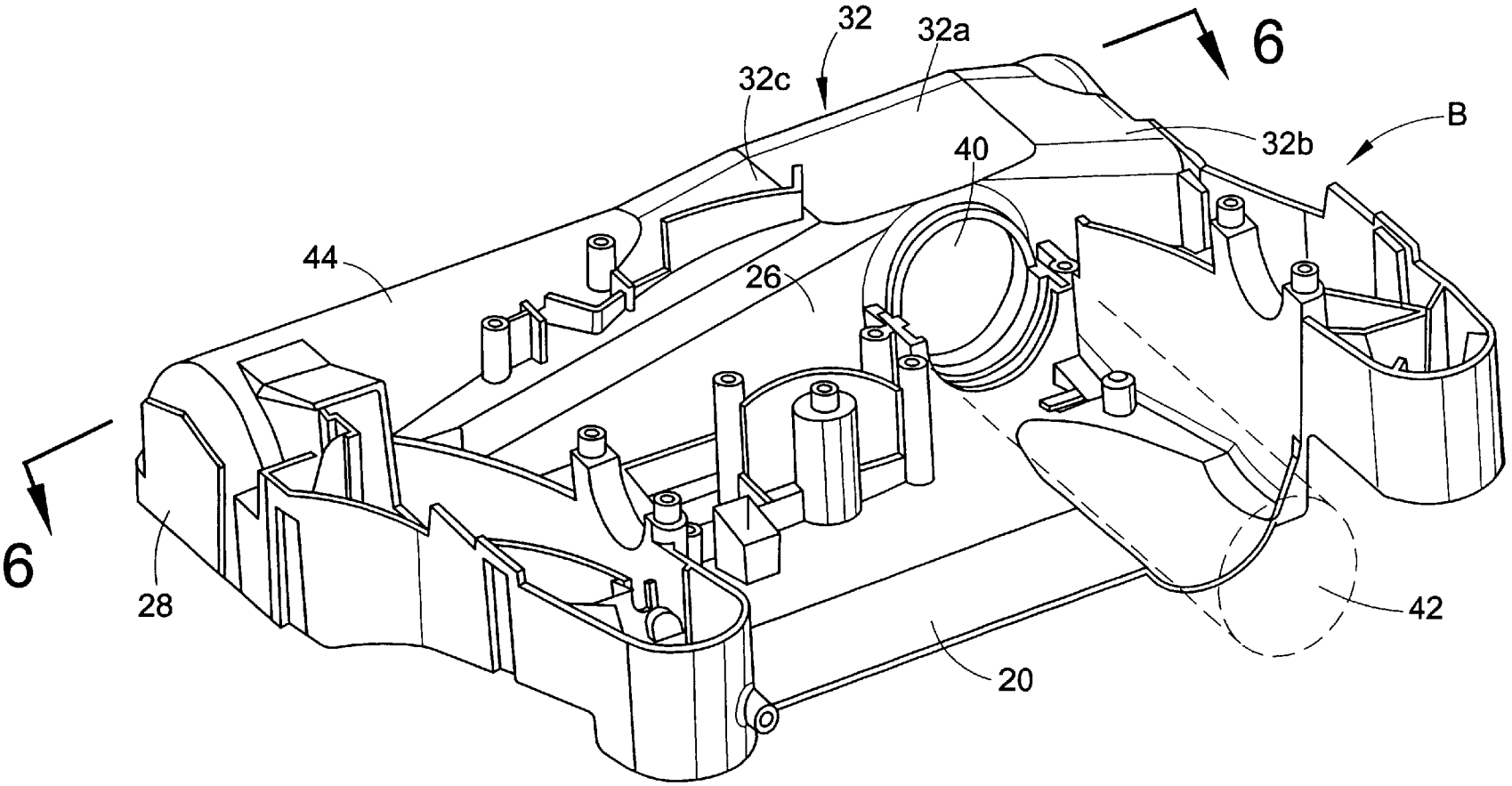
FIG. 5 is a forward perspective view from the right of the nozzle base of FIG. 3, positioned upside up.

An aperture 40 extends through the rear wall 26 of the brushroll chamber proximate the second side wall 30. As best shown in FIG. 5, a discharge duct 42 (shown in phantom), such as a flexible, helical wire-type hose, communicates with and extends rearwardly from the aperture 40. The duct 18 provides a pathway for suction air that is drawn by a source of suction power (e.g. a fan/motor assembly) through the brushroll chamber 22 from the nozzle inlet 36.

Referring again to FIG. 6, the contoured upper wall 32 of the brushroll chamber 22 includes a substantially horizontal, intermediate wall portion 32*a* that extends laterally above the aperture 40. That is, the intermediate wall portion 32*a* extends substantially parallel to a lower edge 26*a* of the rear wall 26 such that a height of the brushroll chamber remains substantially constant throughout the lateral extent of the intermediate wall portion 32*a*, as delineated by the dashed lines in FIG. 6.

In order to increase the velocity of suction air drawn from the nozzle inlet 36 at locations remote from the aperture 40 (such as proximate the slot 38) and thereby increase the performance (i.e. the ability of the suction air to entrain and remove debris that is lifted or swept into the brushroll chamber by the brushroll in a substantially even manner across the full width of the floor nozzle), the contoured upper wall 32 of the brushroll chamber 22 also includes two downwardly tapered wall portions 32*b* and 32*c*. The downwardly tapered wall portion 32*b* extends from a first edge of the intermediate wall portion 32*a* to approximately the side wall 30. Likewise, the downwardly tapered wall portion 32*c* extends from a second edge of the intermediate wall portion 32*a* to approximately the side wall 28.

Both upper wall portions 32*b*, 32*c* taper downward from the intermediate portion 32*a* by about same angle. That is, the upper wall portions 32*b*, 32*c* taper downward from the intermediate portion 32*a* by about 10° to about 25°, and more preferably from about 15° to about 20°. The velocity of suction airflow at a given point along the nozzle inlet can be controlled by providing a particular cross-sectional area for the brushroll chamber proximate the nozzle inlet location. The cross-sectional area of the brushroll chamber at specific locations along the nozzle inlet can be controlled by tapering the upper wall portions 32*b*, 32*c* at a particular angle relative to the intermediate wall portion 32*a*.

It is contemplated that the upper wall portions 32*b*, 32*c* can be tapered relative to the upper wall portion 32*a* to maintain a substantially constant suction airflow velocity along the full width of the nozzle inlet. It is also contemplated that the taper can be controlled to provide a varied level of suction air flow velocity across the full width of the nozzle inlet (i.e. providing a higher suction airflow velocity at the outermost edges of the nozzle inlet relative to the suction airflow velocity at the center of the nozzle inlet).

With continued reference to FIG. 6, the lateral extent of the upper wall portion 32*b* is less than the lateral extent of the upper wall portion 32*c*. Thus, the height of the brushroll cavity proximate the sidewall 30 is greater than the height of the brushroll cavity proximate the slot 38. As a result, the portion of the brushroll chamber proximate the sidewall 30 can still accommodate the brushroll 33. However, this is not the case with the portion of the brushroll chamber 22 proximate the slot 38. That is, the endmost extent of the upper wall section 32*c* tapers below the height of the brushroll 33 when mounted within the chamber 22. Accordingly, a substantially parabolic-shaped recess 44 is defined within the tapered upper wall portion 32*c* to accommodate that portion of the brushroll 33 that extends above the tapered upper wall portion 32*c*. By permitting the upper wall 32 to taper below the agitator, a relatively compact and small form-factor brushroll chamber results.

Figure 2:
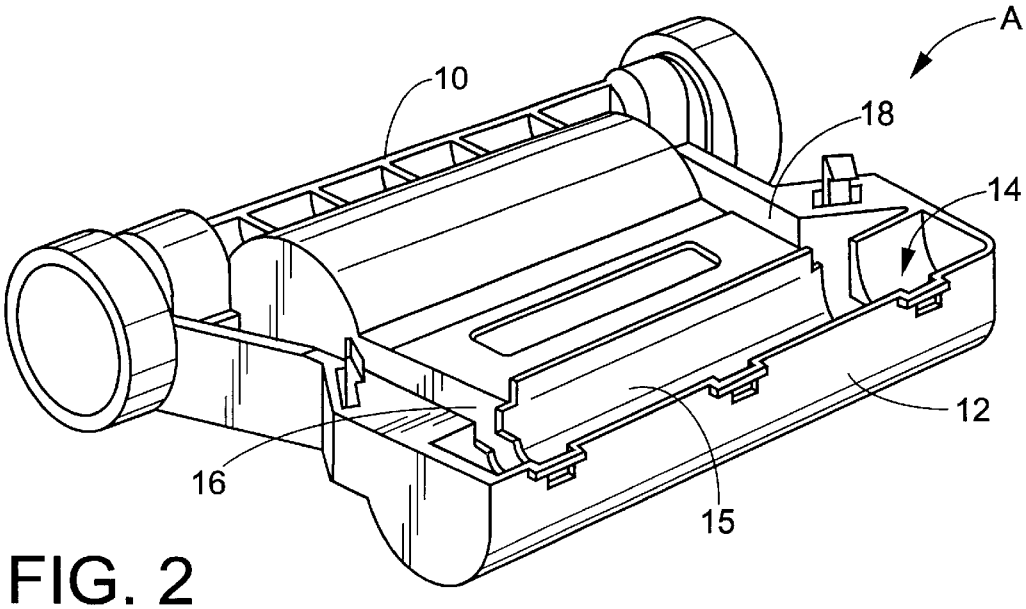
FIG. 2 (PRIOR ART)
FIG. 2 is a perspective view of the conventional nozzle base of FIG. 1 (with a lower cover plate removed), positioned upside down to show a constant cross-section brushroll chamber thereof.

It is fundamental that the velocity of an airflow is inversely related to the cross-sectional area of an airflow pathway. That is, as the cross-sectional area of an airflow pathway decreases, the velocity of the airflow through that pathway increases, and vice versa (assuming that all other variables remain constant). Accordingly, by decreasing the height of the brushroll chamber in both lateral directions away from the aperture 40 (i.e. tapering the upper wall 32 downward), hence reducing the cross-sectional area of the brushroll chamber, the velocity of suction airflow from a given point along the width of the nozzle inlet increases above a level that would have normally occurred had the cross-sectional area of the brushroll chamber remained constant across the width of the nozzle base section as shown in FIGS. 1 and 2. A higher velocity suction airflow had a greater ability to entrain and remove debris that is lifted or swept into the brushroll chamber by the brushroll.

Figure 7:
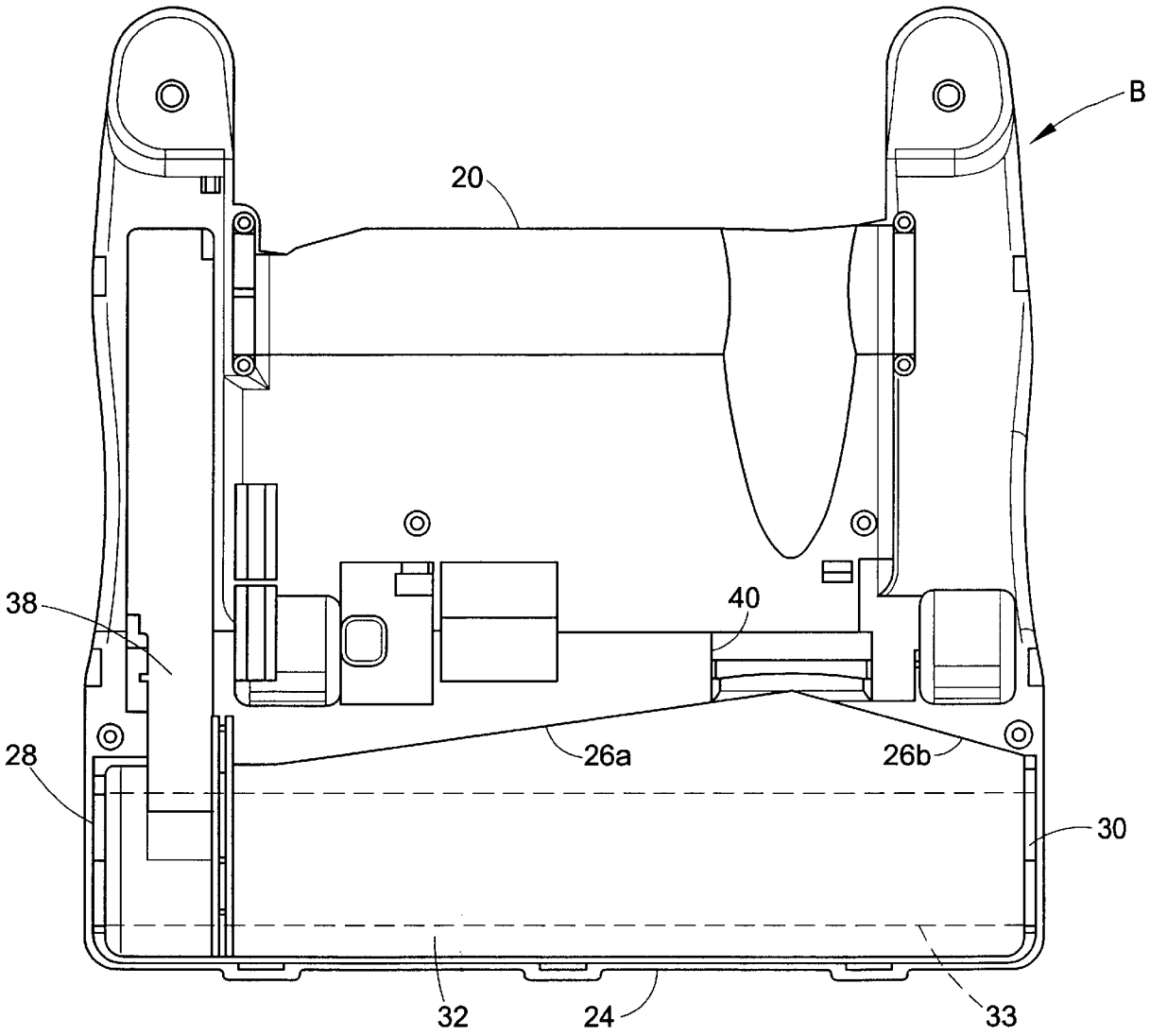
FIG. 7 is a bottom plan view of a nozzle base having a brushroll chamber that incorporates the features of a second embodiment of the present invention therein.

Alternatively, as shown in FIG. 7, the cross sectional area of the brushroll chamber 22, and thus the velocity of suction airflow drawn from the nozzle inlet, can be varied by tapering the depth of the rear wall 26, rather than the height of the upper wall 32. That is, the rear wall 26 includes a first portion 26*a* that tapers forwardly from the rear duct 40 to the remote sidewall 28, and a second portion 26*b* that tapers forwardly from the rear duct 40 to the proximate side wall 30. If the side wall portions 26*a*, 26*b* taper at substantially the same angle, then the depth (measured in a direction transverse to the longitudinal axis of the brushroll chamber), and hence the cross-section, of the brushroll chamber 22 proximate the slot 38 will be less than the cross-section proximate the sidewall 30.

Figure 8:
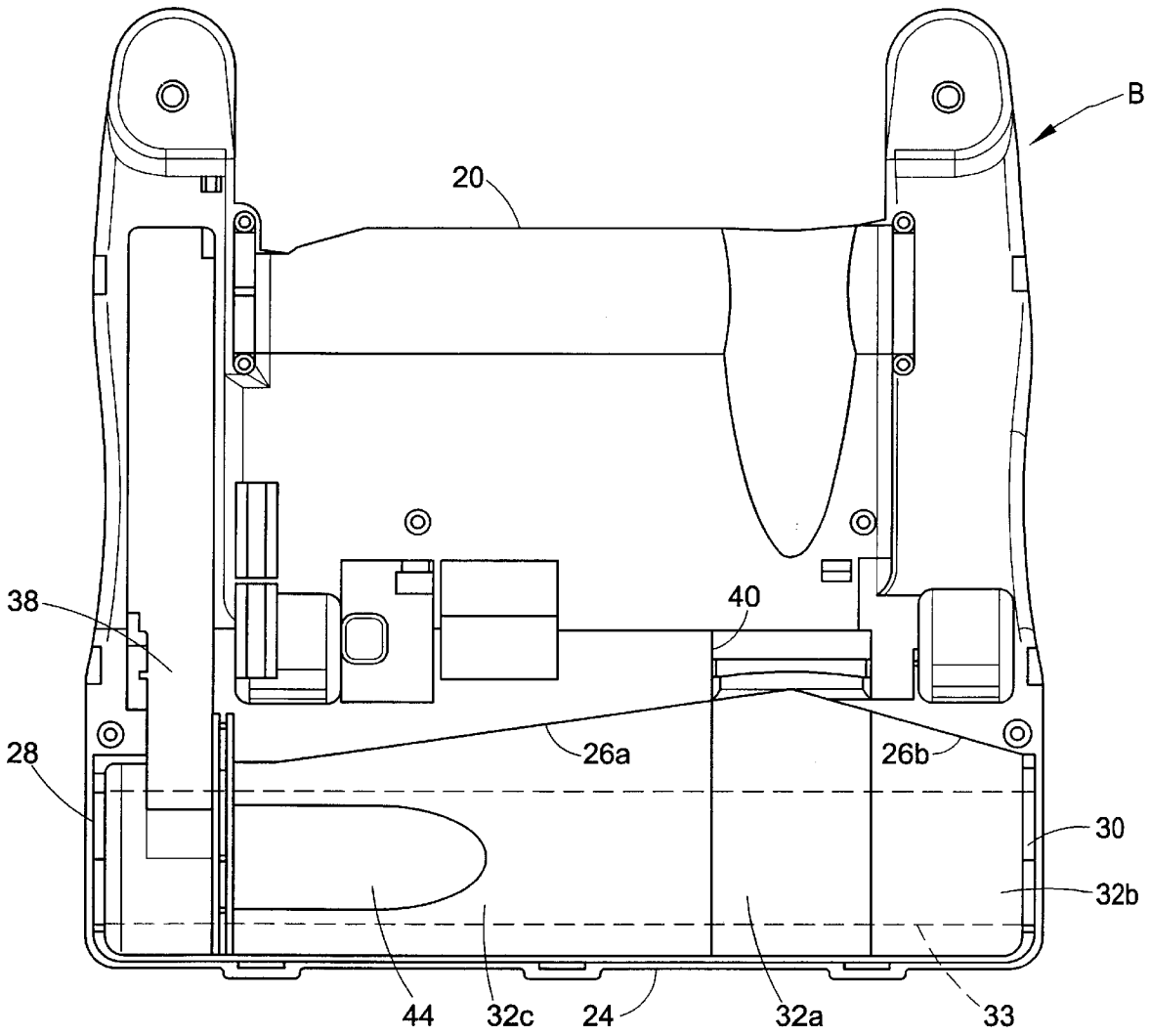
FIG. 8 is a bottom plan view of a nozzle base having a brushroll chamber that incorporates the features of a third embodiment of the present invention therein.

Further, as shown in FIG. 8, the cross-sectional area of the brushroll chamber 22, and thus the velocity of suction airflow drawn from the nozzle inlet, can be varied by tapering both the depth of the rear wall 26 and the height of the upper wall 32. Thus, the cross-sectional area of the brushroll chamber 22 proximate the slot 38 is reduced by the forward taper of the rear wall portion 26*a* and the downward taper of the upper wall section 32*c*. Likewise, the cross-sectional area of the brushroll chamber 22 proximate the side wall 30 is reduced by the forward taper of the rear wall section 26*b* and the downward taper of the upper wall section 32*b*. Reducing the cross-sectional area of the brushroll chamber at locations remote from the rear duct 40 serves to increase the velocity of suction air drawn from the nozzle inlet at that particular location in order to improve the ability of the nozzle base section to more evenly pick-up debris from a surface being vacuumed.

The invention has been described with reference to the preferred embodiments. Obviously, modifications and alterations will occur to others upon reading and understanding the preceding detailed description. It is intended that the invention be construed as including all such modifications and alterations insofar as they come within the scope of the appended claims or the equivalents thereof.

For instance, although it has been expedient to describe the present invention in conjunction with an upright vacuum cleaner, it is contemplated that the present invention is equally applicable to brushroll chambers associated with vacuum cleaner devices other than of the upright-type, such as hand-held vacuum cleaners, canister-type vacuum cleaners having powered floor nozzles, etc.

Further, it is contemplated that the height of the brushroll chamber 22 can be increased so that the tapered upper wall portion 32*a* terminates proximate the slot 38 with a height sufficient enough to accommodate the brushroll 33, thus eliminating the need for the parabolic recess 44. However, this solution is less than optimal because i) the larger size and shape of the brushroll chamber results in a larger nozzle base section that is less maneuverable and more bulky that desired, and ii) the modest reduction in the cross-sectional area of the brushroll chamber fails to generate a sufficient increase in airflow velocity to improve nozzle performance.

Having thus described the preferred embodiments, the invention is now claimed to be:

1. A nozzle base for a vacuum cleaner, the nozzle base comprising a downwardly opening chamber extending across a width of the nozzle base, the chamber adapted to rotatably support an associated agitator, the chamber including an upper wall that tapers downward in a widthwise direction relative to the nozzle base, the upper wall extending at a height below an uppermost extent of the agitator, and the upper wall-including a recess adapted to conform generally to the agitator.

2. The nozzle base of claim 1, wherein the upper wall further includes a first wall section that tapers downward in a first widthwise direction relative to the nozzle base and a second wall section that tapers downward in a second widthwise direction relative to the nozzle base.

3. The nozzle base of claim 2, wherein the upper wall further includes a non-tapered intermediate wall section, the intermediate wall section extending laterally above an air suction aperture that communicates with the chamber.

4. The nozzle base of claim 3, wherein the chamber further includes a rear wall having a rear discharge aperture, the rear wall tapering forward from the rear discharge aperture in a widthwise direction relative to the nozzle base.

5. The nozzle base of claim 4, wherein the rear wall includes a first wall section that tapers forward from the rear discharge aperture in a first widthwise direction relative to the nozzle base, and a second wall portion that tapers forward from the rear discharge aperture in a second widthwise direction relative to the nozzle base.

6. The nozzle base of claim 1, wherein the chamber further includes a rear wall having a rear discharge aperture, the rear wall tapering forward from the rear discharge aperture in a widthwise direction relative to the nozzle base.

7. The nozzle base of claim 6, wherein the rear wall includes a first wall section that tapers forward from the rear discharge aperture in a first widthwise direction relative to the nozzle base, and a second wall portion that tapers forward from the rear discharge aperture in a second widthwise direction relative to the nozzle base.

8. A nozzle base section for a vacuum cleaner, the nozzle base section comprising:

an upright front wall;

an upright rear wall spaced from the front wall and having a suction air aperture;

first and second upright side walls extending transversely between mutual end edges of the front and rear walls, respectively;

an upper wall joined to the front wall, rear wall, first side wall, and second side wall to define a downwardly opening chamber adapted to rotatably support an associated agitator therein;

the upper wall having an intermediate section above the suction air aperture, a first wall section tapering downward from the intermediate section in a direction toward the first upright sidewall, and a second wall section tapering downward from the intermediate section in a direction toward the second upright sidewall; and the second wall section terminating at a height below an uppermost extent of the agitator, and the second wall section including a recess adapted to conform generally to the agitator.

9. The nozzle base of claim 8, wherein the rear wall tapers forward from the suction air aperture in a widthwise direction relative to the nozzle base.

10. The nozzle base of claim 9, wherein the rear wall includes a first wall section that tapers forward from the suction air aperture in a first direction toward the first upright sidewall, and a second wall section that tapers forward from the suction air aperture in a second direction toward the second upright sidewall.

11. A nozzle base for a vacuum cleaner, the nozzle base comprising a downwardly opening chamber extending across a width of the nozzle base, the chamber including an upper wall and a first side wall, the upper wall including a first upper wall section that tapers from a discharge aperture toward the first side wall, the first upper wall section including a recessed portion adapted to accommodate a rotation of an associated agitator.

12. The nozzle base of claim 11, wherein the chamber further includes a second side wall, and the upper wall further includes a second upper wall section that tapers from the discharge aperture toward the second side wall.

13. The nozzle base of claim 12, wherein the chamber further includes a rear wall and a front wall spaced from the rear wall, the real wall tapering toward the front wall.

14. The nozzle base of claim 13, wherein the rear wall includes a first rear wall section that tapers from the discharge aperture toward the front wall in a direction toward the first side wall.

15. The nozzle base of claim 14, wherein the rear wall further includes a second rear wall section that tapers from the discharge aperture toward the front wall in a direction toward the second side wall.

* * * * *